US009567758B2

(12) United States Patent
Sheldon et al.

(10) Patent No.: US 9,567,758 B2
(45) Date of Patent: Feb. 14, 2017

(54) JOINT COMPOUND TOOL INCLUDING OPENER

(71) Applicant: United States Gypsum Company, Chicago, IL (US)

(72) Inventors: Joshua Sheldon, Vernon Hills, IL (US); Nancy L. Bernicke-Grussing, Trevor, WI (US)

(73) Assignee: UNITED STATES GYPSUM COMPANY, Chicago, IL (US)

( * ) Notice: Subject to any disclaimer, the term of this patent is extended or adjusted under 35 U.S.C. 154(b) by 191 days.

(21) Appl. No.: 14/534,073

(22) Filed: Nov. 5, 2014

(65) Prior Publication Data

US 2016/0123022 A1 May 5, 2016

(51) Int. Cl.

| | |
|---|---|
| ***E04F 21/16*** | (2006.01) |
| ***E04F 21/165*** | (2006.01) |
| ***B25F 1/00*** | (2006.01) |
| ***B67B 7/16*** | (2006.01) |
| ***B67B 7/44*** | (2006.01) |

(52) U.S. Cl.

CPC ..... *E04F 21/165* (2013.01); *B25F 1/00* (2013.01); *B67B 7/16* (2013.01); *B67B 7/44* (2013.01); *E04F 21/16* (2013.01); *E04F 21/161* (2013.01)

(58) Field of Classification Search

CPC ..... E04F 21/16; E04F 21/161; E04F 21/165; E04F 21/1657; E04F 21/32; B05C 17/00; B05C 17/10; B25F 1/00; B67B 7/16; B67B 7/44

USPC ..... 15/105; 7/105, 151; 30/123, 136, 400, 30/410; 81/3.09, 3.55, 3.57; D8/34, 45, D8/105; D32/42

See application file for complete search history.

(56) References Cited

U.S. PATENT DOCUMENTS

| | | | | | |
|---|---|---|---|---|---|
| 180,187 | A | * | 7/1876 | Bartlett | B44D 3/162 30/169 |
| 471,562 | A | * | 3/1892 | Minnerly | B67B 7/24 30/142 |
| 699,207 | A | | 5/1902 | Moe | |
| 736,741 | A | * | 8/1903 | Klemm | B26B 11/00 30/143 |
| 825,063 | A | * | 7/1906 | Lawbaugh | B44D 3/162 30/169 |
| 832,455 | A | | 10/1906 | Christensen | |
| 1,277,767 | A | | 9/1918 | Stafford | |
| 1,552,361 | A | | 9/1925 | Trombley | |
| 1,598,420 | A | | 4/1926 | Brossett | |
| 1,597,464 | A | | 8/1926 | Hebner | |
| 1,779,293 | A | | 10/1930 | Rodgers | |
| 2,092,586 | A | * | 9/1937 | Naumovich | B25F 1/04 7/105 |
| 2,213,071 | A | | 4/1940 | Keller | |
| 2,839,110 | A | | 6/1958 | Carpenter | |
| 3,774,252 | A | | 11/1973 | Cantales | |
| 4,967,436 | A | | 11/1990 | Russell | |
| 5,063,627 | A | | 11/1991 | Marra | |
| 5,103,520 | A | | 4/1992 | Mazzo | |

(Continued)

*Primary Examiner* — Mark Spisich

(74) *Attorney, Agent, or Firm* — Greer, Burns & Crain, Ltd.; Pradip Sahu; Philip T. Petti

(57) ABSTRACT

A joint compound tool including a body having a first end, an opposing second end and a handle. A blade portion is attached to the first end of the body and a lid opener is movably attached to the second end of the body, where the lid opener is movable between a storage position adjacent to the handle and an operative position away from the handle.

8 Claims, 8 Drawing Sheets

(56) References Cited

U.S. PATENT DOCUMENTS

| | | | | |
|---|---|---|---|---|
| 5,575,030 | A * | 11/1996 | Girard | A46B 15/0055 15/105 |
| 5,870,786 | A | 2/1999 | Papadopoulos | |
| 5,956,788 | A | 9/1999 | Henke | |
| 5,979,058 | A | 11/1999 | Henke | |
| 6,006,384 | A | 12/1999 | Toal | |
| 6,131,222 | A | 10/2000 | Anderson et al. | |
| 6,769,147 | B1 | 8/2004 | Stubbs | |
| 6,865,761 | B2 | 3/2005 | Henke et al. | |
| 6,954,958 | B2 | 10/2005 | Stubbs | |
| 8,856,995 | B2 * | 10/2014 | Arvinte | A47L 13/022 7/105 |
| 2013/0227794 | A1 | 9/2013 | Wang | |

* cited by examiner

JOINT COMPOUND TOOL INCLUDING OPENER

BACKGROUND

The present application relates generally to hand tools used in wall finishing, and more particularly to such tools used for mixing and applying joint compound.

Joint compound is available in various forms, including a ready-mixed form that is pre-mixed and can be immediately applied to a surface, and in a powder form that must be mixed with water prior to application. Ready-mixed joint compound is conventionally packaged in containers of different sizes. In particular, five gallon buckets of ready-mixed joint compound are commonly used at job sites. Each five gallon bucket of joint compound has a lid that is attached and sealed to an upper edge of a base of the bucket. The lid typically has tabs that must be broken prior to removing the lid from the base. Breaking the tabs is difficult to do by hand, so a tool such as a screwdriver is commonly used. After breaking the tabs, the outer peripheral edge of the lid is segmented such that a user lifts upwardly on each segment to pry the lid away from the base. Again, lifting upwardly on each segment is difficult to do by hand. Therefore, a specialized tool designed to engage the edge of the lid and lift it upwardly is commonly used at job sites to save time and reduce wear on a person's fingers and hands. However, carrying multiple tools at a job site can be cumbersome and difficult, especially when working on a ladder or scaffolding. Also, tools are commonly lost or misplaced, so reducing the number of tools needed at a job site decreases down time and enhances efficiency.

Accordingly, there is a need for a joint compound tool that performs multiple functions.

SUMMARY OF THE INVENTION

The present joint compound tool is a single tool that enables a user to open a container of pre-mixed joint compound and apply the joint compound to a surface or surfaces without having to carry multiple separate tools to and from a job site.

In an embodiment, a joint compound tool is provided and includes a body having a first end, an opposing second end and a handle. A blade portion is attached to the first end of the body and a lid opener is movably attached to the second end of the body, where the lid opener is movable between a storage position adjacent to the handle and an operative position away from the handle. In the storage position, an outer surface of the lid opener is substantially flush with an outer surface of the body so that a user can securely and comfortably grip the handle during use.

In another embodiment, the lid opener includes a groove and at least one gripping edge on at least one side of the groove for gripping and removing a lid of a container. In a further embodiment, the lid opener includes a groove and opposing gripping edges for gripping and removing the lid of the container.

In still another embodiment, a joint compound tool is provided, and includes a body including a first end, an opposing second end and a handle, and a blade portion attached to the first end of the body. A lid opener is movably attached to the second end of the body, the lid opener includes a groove and at least one gripping edge on at least one side of the groove, wherein said at least one gripping edge is configured to engage a lid of a container. The lid opener is movable between a storage position within the handle and an operative position extending away from the handle and the body includes a receptacle configured to receive the lid opener when the lid opener is in the storage position, the groove opens toward the receptacle when the lid opener is in the storage position.

DETAILED DESCRIPTION

The present joint compound tool 20 is a single tool that includes a blade portion 22 and a lid opener 24 that, depending on which portion is used, enables a user to open a container of pre-mixed joint compound and apply the joint compound to a surface or surfaces. Thus, the present multi-functional joint compound tool 20 saves time and costs by reducing the number of separate tools that need to be brought to, carried and used at a job site.

Figure 3:
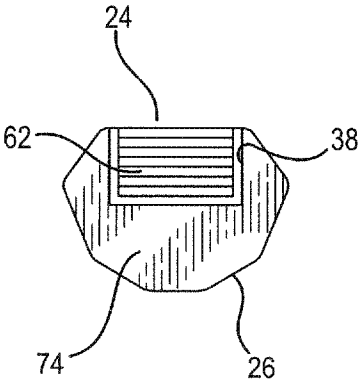
FIG. 3 is an end view of the tool of FIG. 1.
Figure 4:
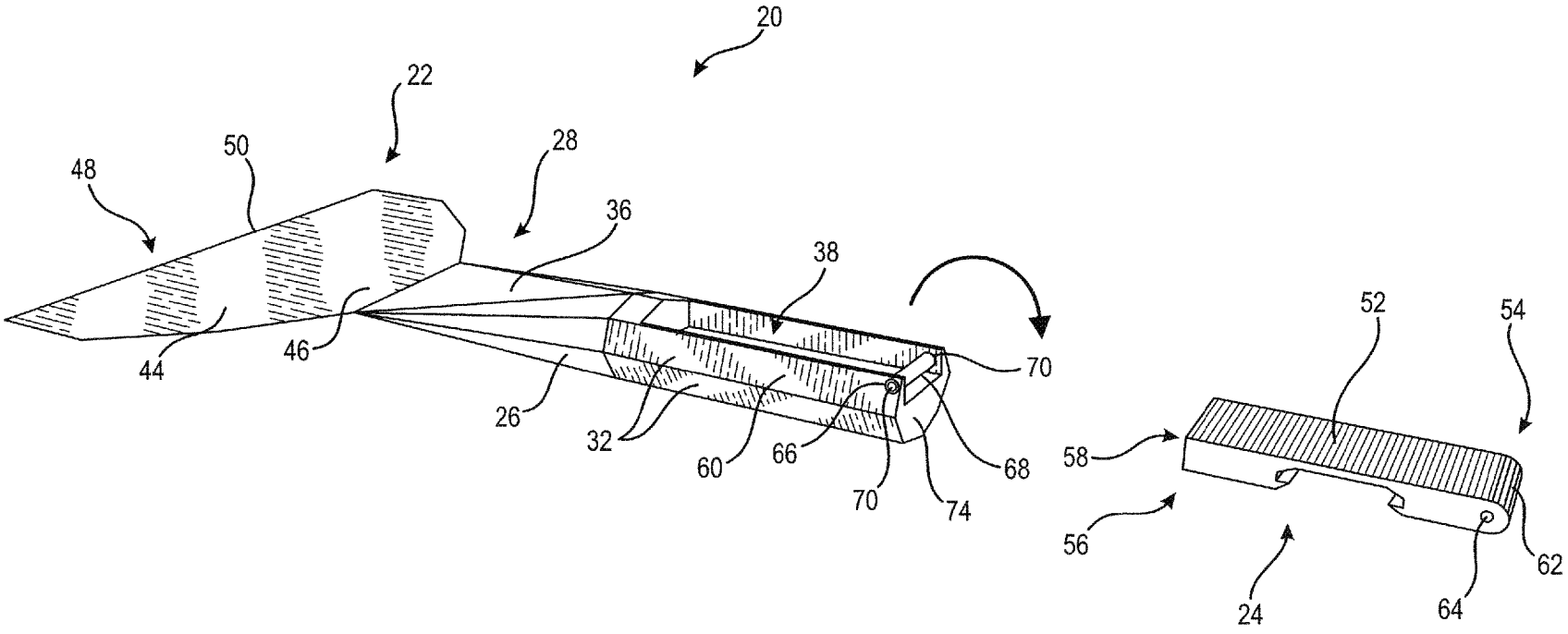
FIG. 4 is an exploded perspective view of the tool of FIG. 1.
Figure 5:
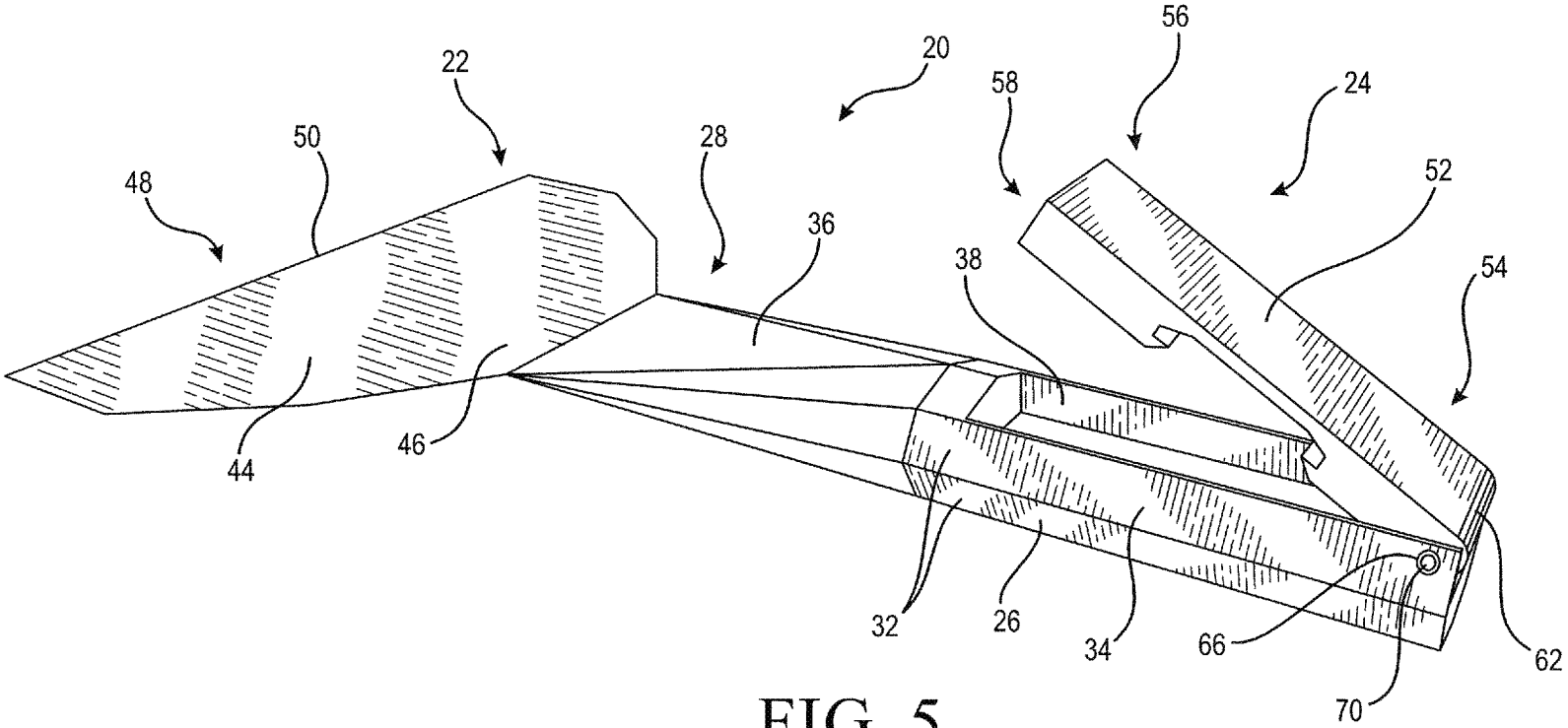
FIG. 5 is a perspective view of the tool of FIG. 1 showing the lid opener in a partially opened position.

Referring now to FIGS. 1-7, the present joint compound tool 20 includes a body 26 having a first end 28 and an opposing second end 30. As shown in FIG. 5, the body 26 has a generally uniform, multi-faceted shape formed by interconnecting flat surfaces 32. Further, the body 26 is preferably made of a durable material such as a molded plastic or rubber but may be made with any suitable material or combination of materials. It should further be appreciated that the body 26 may be any suitable size or shape. To enable a user to grip and use the tool 20, the body 26 includes a handle portion or handle 34 that has a generally uniform size and shape. Specifically, the size and shape of handle 34 is configured to enable a user to comfortably and securely grip the handle with their hand to manipulate the tool. The body 26 also includes a tapered portion 36 extending between the handle 34 and the first end 28 of the body and a receptacle or recessed area 38 having a closed end 40 and an open end 42 (FIG. 2) where the open end is at the second end 30 of the body. As shown in FIGS. 3 and 4, the receptacle 38 has a generally rectangular shape in cross-section, and when viewed from above. It should be appreciated that the receptacle 38 may have a semi-circular shape or any suitable shape.

Figure 1:
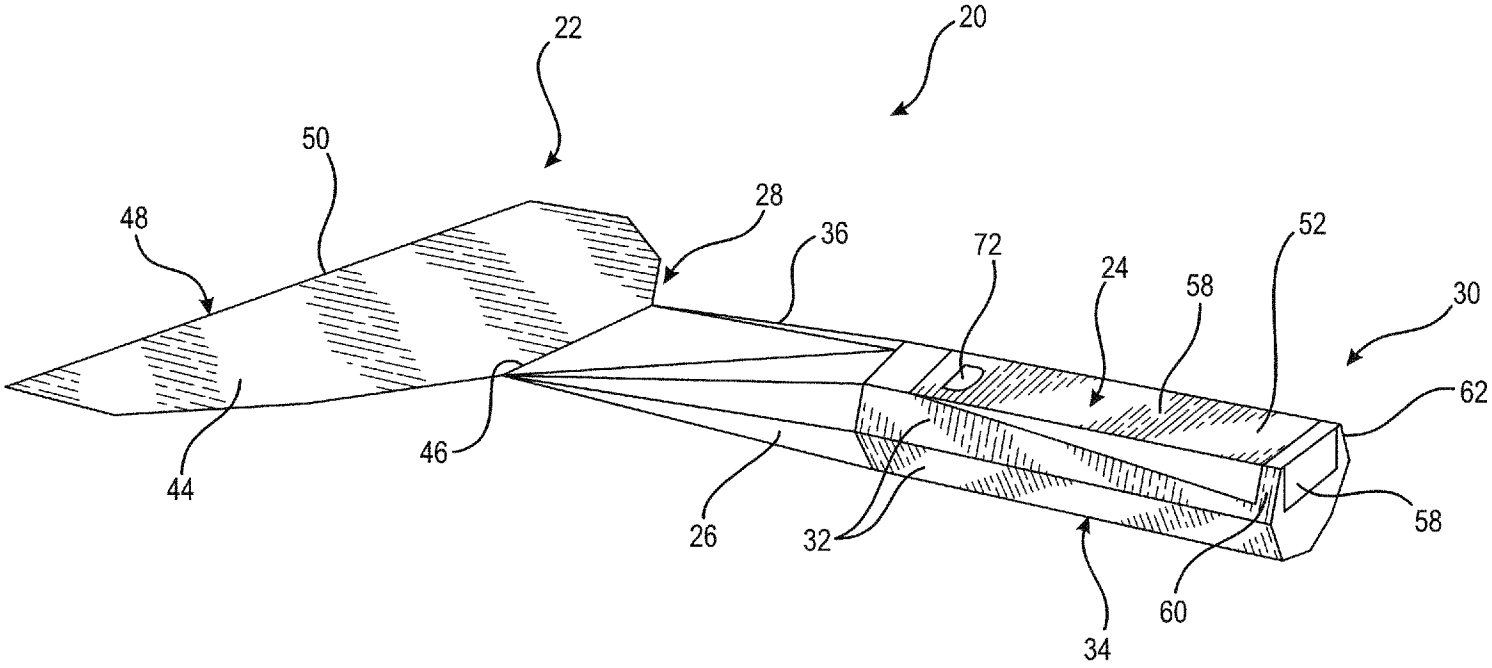
FIG. 1 is a perspective view of the present tool.
Figure 2:
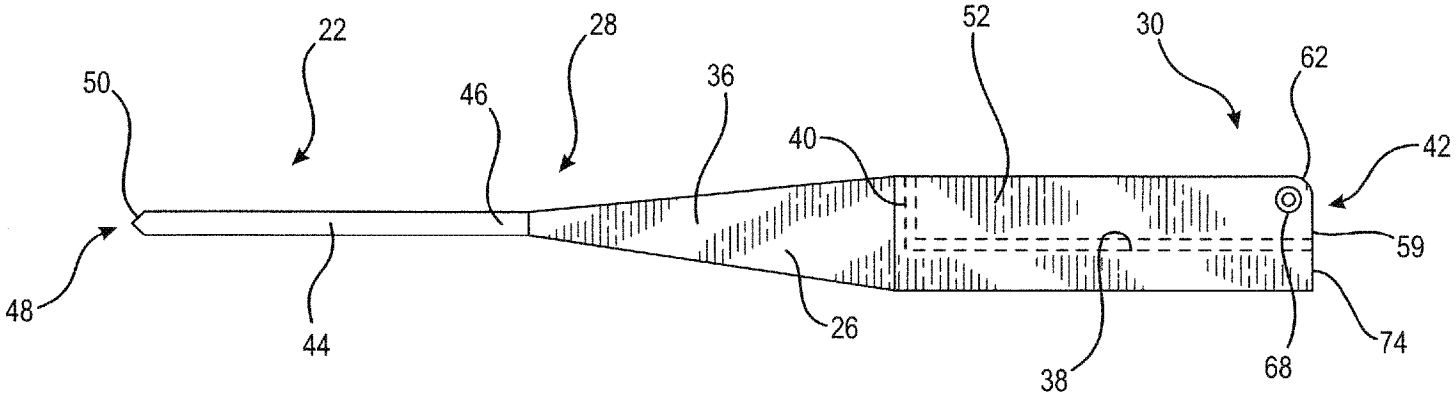
FIG. 2 is a side view of the tool of FIG. 1.

In the illustrated embodiment, the blade portion 22 is attached to the first end 28 of the body 26 and includes a blade 44 having a connecting end 46 attached to the first end 28 of the body and an application end 48 forming a pointed edge 50 configured for applying joint compound to a surface or surfaces. As shown in FIG. 1, the blade 44 may form the entire blade portion 22. Alternatively, the blade 44 may be smaller than the blade portion 22 and connected to an end of the blade portion. The blade 44 is preferably made of a metal, such as stainless steel, but may be made with any suitable material. Furthermore, the blade portion 22 and the body 26 may be made of the same material or different materials.

Figure 6:
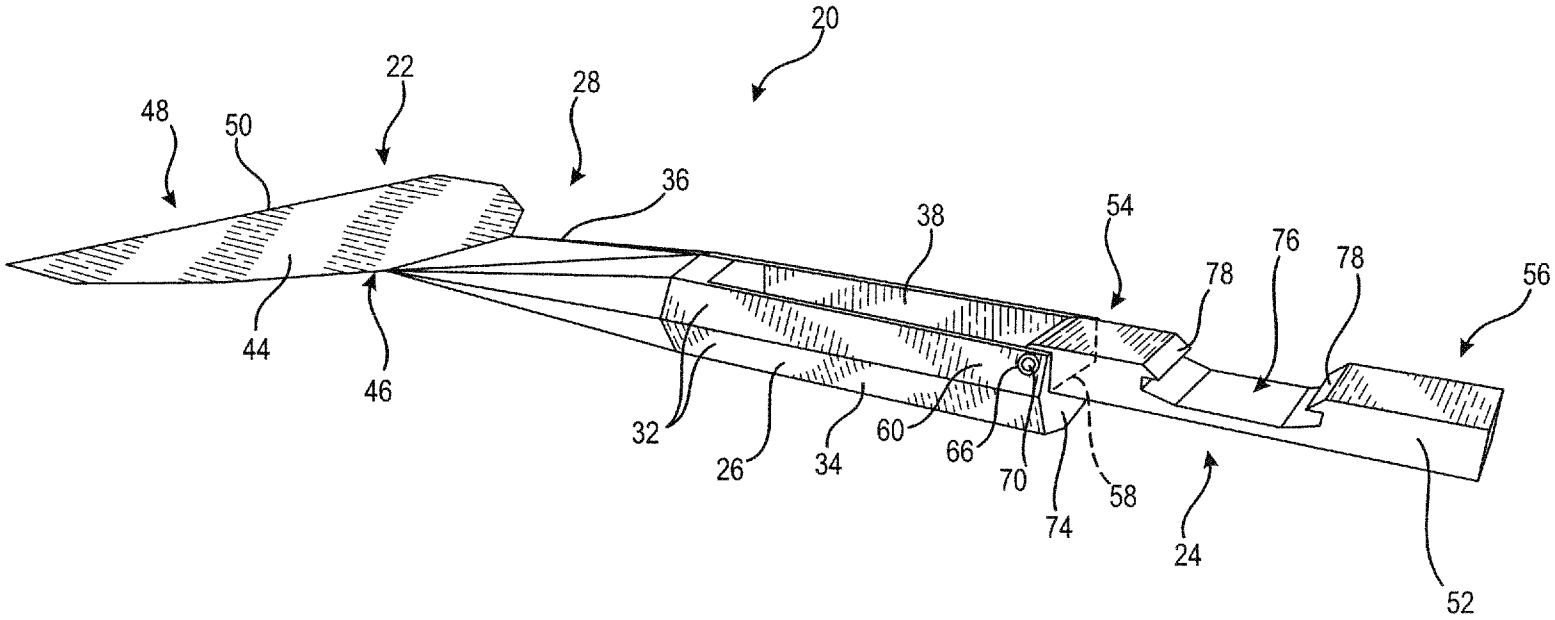
FIG. 6 is a perspective view of the tool of FIG. 1 showing the lid opener in a fully open position.

The lid opener 24 includes a body 52 that is movably connected to the second end 30 of the body 26 and moves between a first or stored position (FIG. 1) to a second or operative position (FIG. 6). The body 52 of the opener 24 has a first end 54 and an opposing second end 56. As shown in FIGS. 1 and 4, the opener body 52 has a generally rectangular shape that corresponds with, and is complementary to, the shape of the receptacle 38, so that when the opener 24 is in the stored position, an outer or exposed surface 58 of the opener is within the handle 34 and is substantially flush with an outer surface 60 of the handle. As shown in FIG. 4, the first end 54 of the opener body 52 has a rounded outer surface 62 and includes a through-hole 64.

To connect the first end 54 of the body 52 to the handle 34, the through-hole 64 is aligned with opposing openings 66 on the handle 34 and a pivot pin 68 is inserted through one of the openings 66, the through-hole 64 and then the other opening 66. In the illustrated embodiment, the pivot pin 68 has an outer diameter that is greater than an inner diameter of the openings 66 and less than an inner diameter of the through-hole 64. In this way, the ends 70 of the pivot pin 68 are secured in the openings 66 of the handle 34 by a friction-fit, while enabling the opener 24 to move or pivot about the pivot pin. In another embodiment, one of the ends 70 of the pivot pin 68 and one of the openings 66 in the handle 34 are threaded such that the threaded end of the pivot pin threadingly engages the threaded opening to secure the pivot pin to the handle 34.

Referring to FIGS. 1 and 6, the second end 56 of the opener body 52 includes a recessed area or finger grip 72 that enables a user to lift the second end of the opener and move or pivot the opener to the second or operative position in which the opener 24 extends from the handle 34. It should be appreciated that the finger grip 72 may be any suitable size or shape. When the opener 24 is in the second position, the outer surface 58 of the opener body 52, and more specifically, the end surface 59 of body 52 abuts or engages an outer end surface 74 of the body 26 to act as a stop and inhibit further movement of the opener about the pivot pin 68.

Figure 7:
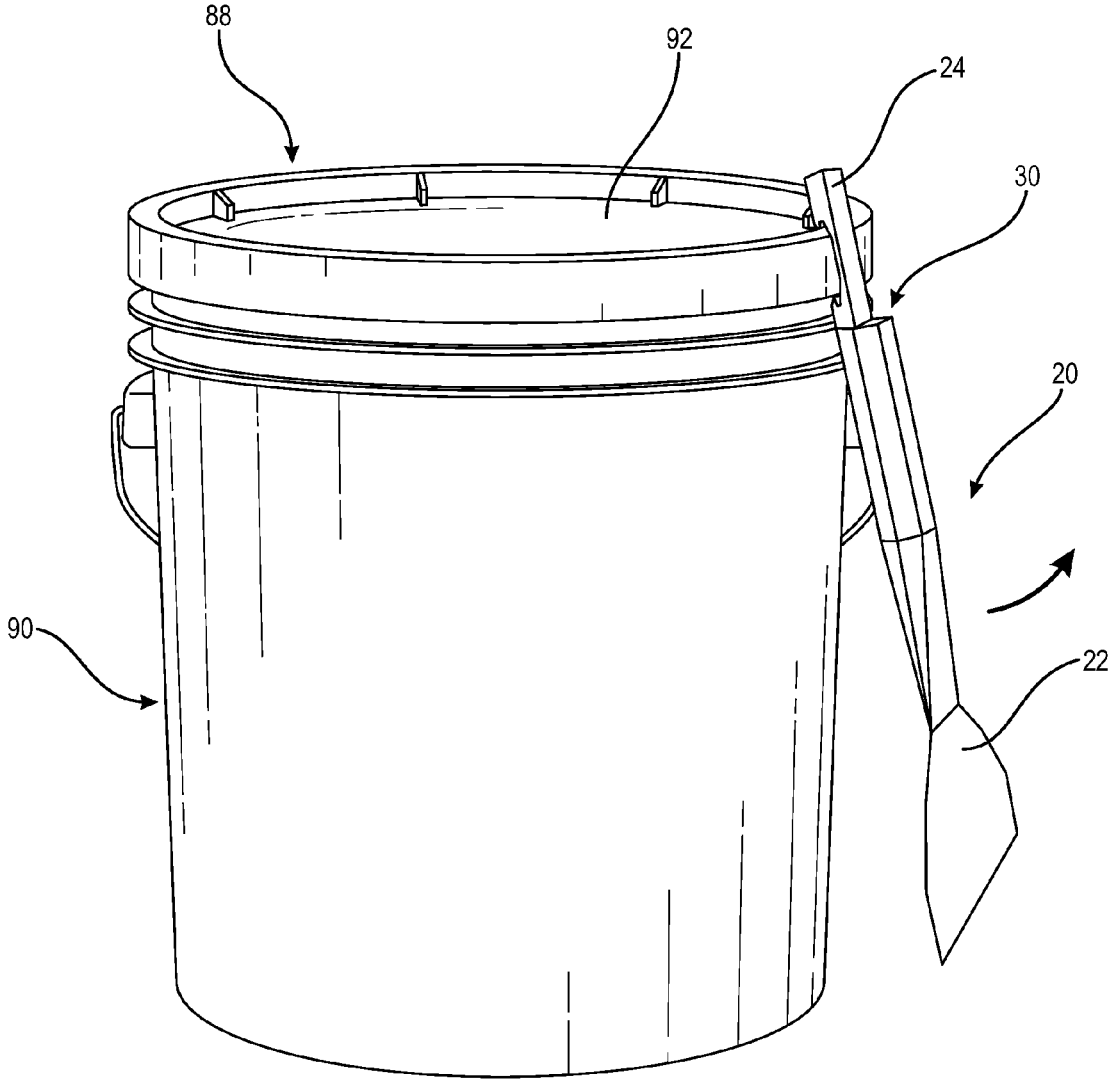
FIG. 7 is a perspective view of the tool of FIG. 1 showing the lid opener in the second, operative position and engaged with a container lid.

Once in the open position shown in FIG. 6, the opener 24 can be used to open a joint compound container, such as for example, a five gallon container of pre-mixed joint compound. Specifically, the opener 24 includes an elongated groove 76 with a pointed, claw-like gripping edge 78 on each side of the groove where the groove 76 opens towards the receptacle 38 when the opener 24 is in the closed position of FIG. 1. In the open or operative position, the outer end 59 of the lid opener 24 engages or abuts at least a portion of the outer surface 74 (FIG. 4) of the body 26 to enable the upper portion of the body 26, namely the blade portion 22, tapered portion 36 and handle 34 to be gripped by a user and pivoted toward the container lid to pry the lid away from the container using the lid opener 24. In use, one of the gripping edges 78 is positioned underneath a lip of a lid 88 on a joint compound container 90 and the other gripping edge 78 engages a top surface 92 of the lid. In this position, as shown in FIG. 7, the tool 20 acts as a lever, where pivoting the blade portion 22 of the tool generally upwardly causes the gripping edge engaged with the lip of the lid to pull upwardly and outwardly on the container lip to pry that portion of the lid 88 away from the container 90.

Figure 8:
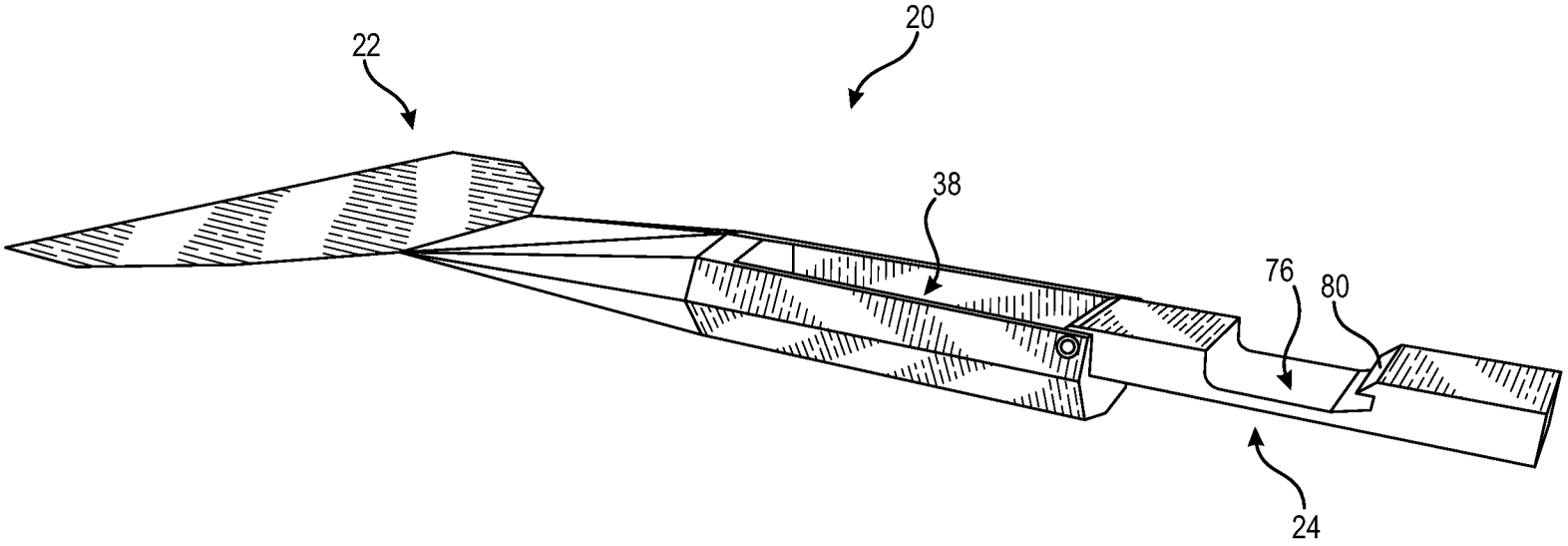
FIG. 8 is a perspective view of another embodiment of the present tool with a lid opener having one gripping edge.

As described above, joint compound containers typically include breakable tabs about the periphery of the lid for sealing the lid before use. Thus, the above prying action using the tool 20 is repeated about the periphery of the lid until each of the tabs is broken and the lid is removed from the container. In other embodiments, the opener 24 may have one gripping edge 80 (FIG. 8) or a plurality of gripping edges 82 on one or both sides of the groove 76 (FIG. 9).

Referring to FIGS. 1, 5 and 6, after the lid is removed from the container, the opener 24 is moved or pivoted from the second or operative position to the first or stored position. As described above, in the stored position, the outer surface 58 of the opener body 52 is substantially flush with the outer surface 60 of the handle 34 such that a user can securely and comfortably grip the handle while applying joint compound to a surface with the blade portion 22.

Figure 9:
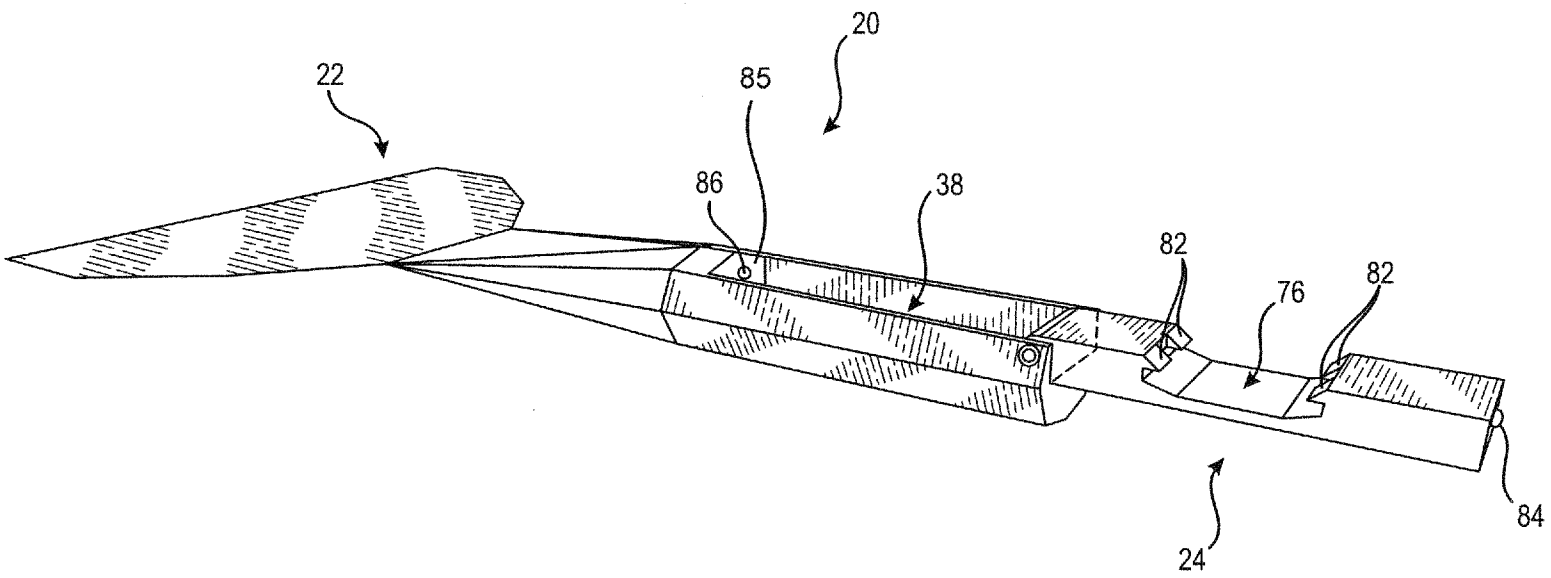
FIG. 9 is a perspective view of a further embodiment of the present tool with a lid opener having multiple gripping edges on each side of the groove.

As shown in FIG. 9, in an embodiment, the opener 24 includes a tab or lug 84 and the inner surface 85 of the receptacle 38 includes a corresponding recess 86 such that the tab engages the recess when the opener is moved to the stored position to temporarily secure the opener in that position. The tab 84 is disengaged from the recess 86 when the opener 24 is lifted away from the receptacle 38 by a user.

As described in the above embodiments, the present joint compound tool 20 is a multi-functional device that enables a user to quickly and easily open a joint compound container and also to apply the joint compound to a surface without having to find and carry multiple tools to a job site or different locations at a job site, which saves time and lessens the burden on the user.

While particular embodiments of the tool and methods of using the tool have been shown and described, it will be appreciated by those skilled in the art that changes and modifications may be made thereto without departing from the invention in its broader aspects and as set forth in the following claims.

What is claimed is:

1. A joint compound tool comprising:

a body including a first end, an opposing second end and a handle, said body including a receptacle extending from said second end toward said first end, opposing edges of said handle defining opposing first and second sides of said receptacle, the depth of said receptacle extending between said first and second sides;

a blade portion attached to said first end of said body, said blade portion defining a plane; and a lid opener movably attached to said second end of the said body such that said lid opener pivots about an axis substantially parallel to said plane defined by said blade portion, said lid opener having a generally flat first side and a second side, said second side including a groove and opposing gripping edges, wherein said lid opener is movable between a storage position within said receptacle in which said second side of said lid opener is within said handle and said first side of said lid opener is substantially flush with said opposing edges of said handle, and an operative position away from said handle in which said groove and said opposing gripping edges are exposed for use, and movement of said lid opener between said storage position and said operative position is in a plane substantially perpendicular to said plane defined by said blade portion.

2. The tool of claim 1, wherein an outer surface of said lid opener and an outer surface of said body are substantially flush with each other when said lid opener is in the storage position.

3. The tool of claim 1, wherein said lid opener includes a tab and said receptacle includes a recess, wherein said tab engages said recess when said lid opener is in the storage position to temporarily secure said lid opener in the storage position.

4. The tool of claim 1, further comprising a pivot pin inserted through corresponding openings in said body and a through-hole in said lid opener.

5. The tool of claim 1, wherein said blade portion includes a blade.

6. The tool of claim 1, wherein said lid opener includes a finger grip configured to enable said lid opener to be lifted and moved away from said body.

7. A joint compound tool comprising:

a body including a first end, an opposing second end and a handle, said body including a receptacle;

a blade portion attached to said first end of said body, said blade portion defining a plane; and a lid opener movably attached to said second end of the said body such that said lid opener pivots about an axis substantially parallel to said plane defined by said blade portion, said lid opener having a first side and a second side, said second side including a groove and opposing gripping edges, wherein said lid opener is movable between a storage position within said receptacle in which said second side of said lid opener is within said handle and said first side of said lid opener is substantially flush with an outer surface of said handle, and an operative position away from said handle in which said groove and said opposing gripping edges are exposed for use, and movement of said lid opener between said storage position and said operative position is in a plane substantially perpendicular to said plane defined by said blade portion.

8. The tool of claim 7, wherein said lid opener includes a tab and said receptacle includes a recess, wherein said tab engages said recess when said lid opener is in the storage position to temporarily secure said lid opener in the storage position.

* * * * *